United States Patent [19]

Bennett et al.

[11] 4,113,447

[45] Sep. 12, 1978

[54] METHOD OF CONDITIONING FLUE GAS

[75] Inventors: Robert P. Bennett, Bridgewater; Alfred E. Kober, Hopatcong, both of N.J.

[73] Assignee: Appollo Chemical Corporation, Whippany, N.J.

[21] Appl. No.: 792,939

[22] Filed: May 2, 1977

[51] Int. Cl.[2] ..... B03C 3/00

[52] U.S. Cl. ..... 55/5; 55/262; 423/215.5

[58] Field of Search ..... 55/5, 262; 423/215.5, 423/242, 244

[56] References Cited

U.S. PATENT DOCUMENTS

| | | | |
|---|---|---|---|
| 3,665,676 | 5/1972 | McKewen | 55/5 |
| 3,880,629 | 4/1975 | Dulin et al. | 65/27 |
| 4,042,348 | 8/1977 | Bennett et al. | 55/5 |
| 4,043,768 | 8/1977 | Bennett et al. | 55/5 |

*Primary Examiner*—Bernard Nozick
*Attorney, Agent, or Firm*—James & Franklin

[57] ABSTRACT

The collection characteristics of particles entrained in a particle-laden gas for collection by an electrostatic precipitator are improved by injecting finely divided sodium bisulfate into a particle-laden gas stream formed by the burning of coal while the gas has a temperature of 200°–900° C. Sufficient sodium bisulfate is injected to provide 75–1250 grams per metric ton of coal burned to form the gas. After injection, the stream is directed through a heat exchange means and finally into the precipitator to collect the particles therein.

28 Claims, No Drawings

METHOD OF CONDITIONING FLUE GAS

BACKGROUND OF THE INVENTION

This invention relates generally to the separation of particulate material from a gas stream and particularly to a method of chemically conditioning a particle-laden gas stream so that the particles may be efficiently removed in an electric field.

DESCRIPTION OF THE PRIOR ART

One conventional way of collecting dust particles from a gas stream in which the particles are entrained is by using an electrostatic precipitator. This apparatus utilizes a corona discharge to charge the particles passing through an electrical field established by a plurality of discharge electrode wires suspended by insulators in a plane parallel to a grounded collecting electrode plate. The charged particles are attracted to the collector plate from which they may then be removed by vibrating or rapping the plate. Examples of this type of precipitator are found in U.S. Pat. Nos. 3,109,720 and 3,030,753.

Dust particles have different collection characteristics depending somewhat upon their source. One such characteristic is resistivity which is measured in ohm-centimeters. For example, where the source of particles is a coal-fired boiler, there is usually a predictable relationship between the type of coal burned and the resistivity of the particles in the flue gas. Typically, low sulphur coal, i.e., less than 1 percent sulphur, produces particles having high resistivity, e.g., $10^{13}$ ohm-centimeters resistivity; coal with 3–5 percent sulphur produces particles having $10^{8}$–$10^{10}$ ohm-cm resistivity; and poor combustion of coal produces particles having $10^{4}$–$10^{5}$ ohm-cm resistivity.

It has been found heretofore that the most efficient collection or precipitation of particles occurs when their resistivity is about $10^{8}$–$10^{10}$ ohm-centimeters. When the resistivity is lower than this, e.g., in the collection of highly conductive dusts, the dust particle loses its charge immediately upon reaching the collecting electrode. Once the charge is lost, the particle reentrains back into the gas stream and has to be charged again. This results in a considerable loss of efficiency. Conversely, when the resistivity is higher than this, e.g., in the collection of highly resistive dusts, the dust particles act as electrical insulators and cannot conduct charges on the collected dust layer to the grounded electrode. As this condition progresses, the voltage drop across the dust layer increases, causing a drop on the applied voltage between the high voltage emitting wire and grounded electrode. Since high applied voltage is required to maintain corona current, the current also drops, causing the precipitator performance to deteriorate. As the voltage across the dust layer increases, eventually the dielectric strength of the dust layer is exceeded, back ionization occurs and the precipitator becomes no better than a settling chamber. However, when the particles are of the preferred resistivity, a balance is achieved between the tendency to have either overcharged or undercharged particles and optimum precipitation efficiency results.

The bulk resistivity of the particles to be conditioned can be determined, if desired, by measuring the bulk resistivity of a sample of such particles in accordance with the American Society of Mechanical Engineers Power Test Code No. 28 (ASME PTC 28) entitled "Determining the Properties of Fine Particulate Matter" (paragraph 4.05 describes the "Measurement of Resistivity" and Appendix FIGS. 7–10 describe the apparatus used for measuring the resistivity). Attempts to control the resistivity of the particles have been made with only limited success. For example, to this end, there have been injected into the gas stream various chemicals such as water, anhydrous ammonia, water and ammonia, sulfuric acid, sulfur trioxide, and phosphoric acid. These chemicals have usually been injected for reaction in situ with other chemicals naturally present in the gas stream with the hope that a conditioner would be formed in the gas stream. As a result, the resistivity of the particles in the gas has been of a random and uncontrolled nature and entirely dependent on the chemical composition of the gas and/or particles in the gas. Examples of and references to chemicals injected into the gas stream and the conditioner formed thereby may be found in the following patents: water - U.S. Pat. No. 2,746,563, Great Britain Pat. No. 932,895; ammonia - U.S. Pat. No. 1,291,745, U.S. Pat. No. 2,356,717; water and ammonia - U.S. Pat. No. 2,501,435, U.S. Pat. No. 3,523,407; sulfuric acid - U.S. Pat. No. 2,746,563, Great Britain Pat. No. 932,895, U.S. Pat. No. 2,602,734; sulfur trioxide - U.S. Pat. No. 2,746,463, Great Britain Pat. No. 932,895, Great Britain Pat. No. 933,286; and phosphoric acid - U.S. Pat. No. 3,284,990.

U.S. Pat. No. 3,523,407 describes a process for injecting water, ammonia and, when it is not present as a combustion product, $SO_3$, to alter the resistivity of entrained dust and make it easier to collect in an electrostatic precipitator. The water and ammonia are injected, preferably separately, prior to the passage of the flue gas through the preheater in an area where the temperature is at least 400° F. (204° C.) and preferably at least 450° F. (232° C.). The disadvantages of this approach are obvious. First, depending on the gas to be treated, one needs either two or three complete injection systems, and one must handle at least one and sometimes two toxic gases. Second, a relatively large amount (i.e., 40–80 gals.) of water must be injected per million cubic feet of flue gas, and the amount of water must be varied depending on the $SO_3$ content of the gas being conditioned. Third, the conditioning depends on a chemical reaction occurring in the flue; e.g., a molecule each of ammonia, water and sulfur trioxide combining to form ammonium bisulfate.

U.S. Pat. No. 3,665,676 describes a conditioner solution comprising an aqueous solution of ammonium sulfate or ammonium bisulfate, but specifically teaches that the conditioner solution must be injected into the gas stream only after the air preheater to avoid the tendency of the chemical therein (e.g. ammonium bisulfate) to deposit in and clog the air preheater when the conditioner solution is injected upstream from the air preheater. Such clogging is completely unacceptable because the entire unit must then be shut down to wash the air preheater. By injecting the conditioner solution after the air heater, this problem is overcome; however, the engineering problem of insuring adequate distribution and mixing of the additive with the flue gas prior to the precipitator becomes much more difficult. The flue in a large coal fired boiler can have a cross-sectional area after the air preheater of as large as 1000 sq. ft.; at best, only a few seconds mixing time are available prior to the precipitator, and often there is severe stratification of gas flow in this region. Obviously, the further upstream from the precipitator that the solution can be injected, the better chance of complete mixing; however, the requirement of the patent that injection be downstream of the preheater limits the opportunity for improved mixing. In addition, the turbulence caused by passing the flue gas and conditioner solution through the constrictions of an air preheater would also contribute significantly to mixing; however, the same patent requirement also limits this opportunity for improved mixing. Previous work described in application Ser. No. 673,364 filed April 5, 1976 and entitled "Method of Conditioning Flue Gas" and in application Ser. No. 710,582 filed Aug. 2, 1976 and entitled "Method of Conditioning Flue Gas", both of which are owned by the assignee of this application, has shown that the problem of air preheater pluggage when using ammonium sulfate or bisulfate can be overcome, while still maintaining effectiveness, only by applying the additive within a specific elevated temperature range. This represents a constraint on the use of this additive in those installations where it is difficult or inconvenient to inject the additive into the furnace at points where those temperatures exist, and in addition it sometimes makes it difficult to avoid pluggage in those installations where there are wide variations in operating load which in turn cause wide variations in the temperature at the point of injection.

Another drawback in the use of ammonium salts to condition fly ash becomes apparent when the fly ash is used as a component of cement as is often done. Since cement contains lime, a highly basic solution results when water is added. This basic solution reacts with ammonium salt residues on the treated fly ash present in the cement mixture to liberate ammonia gas. The toxic ammonia gas liberated in this process constitutes, at best, a nuisance and can be a health hazard when the cement/fly ash composition is used in a confined area.

Sodium salts have been used to reduce fly ash resistivity and enhance electrostatic precipitator performance, but in a manner different from that described in the present invention. This work, reviewed by R. E. Bickelhaupt*, involved the incorporation of $Na_2O$ as an integral part of fly ash by addition of sodium compounds to the coal before combustion, thereby lowering the bulk resistivity of the fly ash produced from the coal.

*R. E. Bickelhaupt, Sodium Conditioning to Reduce Fly Ash Resistivity, Environmental Protection Agency Technology Serial, EPA - 650/2-74-092, October, 1974.

This method has the disadvantages of: (1) requiring an uneconomically high concentration of conditioner (up to 2.5% added $Na_2O$ based on the ash); (2) possibly increasing the fouling or slagging potential of the coal because of the high sodium concentration. In contrast, since the method of the present invention alters only the surface resistivity of the fly ash, a much lower conditioner concentration is required (typically $Na_2O$ = 0.075% of the ash at a rate of 440 grams of sodium bisulfate per metric ton and an ash content of 15%). Also, since the conditioner is added to the flue gas stream well past the combustion zone of the boiler, it does not alter the slagging or fouling tendency of the fly ash.

In an article entitled "A Comparison of Chemical Additives As Aids to the Electrostatic Precipitation of Fly-Ash" by J. Dalmon and D. Tidy at pages 721–734 of "Atmospheric Environment", Volume 6, published in Great Britain in 1972 by Pergamon Press, mention is made of sodium sulfate (but not sodium bisulfate) as a possible flue gas conditioning agent, but the article states that sodium sulfate is effective in that regard only in the absence of $SO_2$, and since $SO_2$ is always present as a major component of flue gas derived from the combustion of coal, this article teaches that sodium sulfate would be ineffective under normal boiler operating conditions, and says nothing concerning the utility of sodium bisulfate in that regard.

Accordingly, an object of the present invention is to provide an improved method of conditioning a particle-laden gas stream to improve the collection characteristics of the particles entrained therein.

Another object is to provide such a method where only one injection system is needed to inject the conditioning agent.

A further object is to provide such a method where there is no necessity to handle one or more toxic gases.

It is also an object to provide such a method which insures adequate mixing of the conditioning agent with the flue gas by injecting it upstream from the preheater.

It is another object to provide such a method which injects a conditioning agent whose chemical and physical properties are such that it does not deposit upon and plug the preheater.

It is a further object to provide a method which conditions the particle-laden gas stream using a much smaller quantity of conditioning agent than hitherto thought possible.

A further object is to provide a conditioned fly ash which may be used as a component of cement without constituting a possible health hazard.

SUMMARY OF THE INVENTION

It has now been found that the above and related objects of the present invention are obtained by a method of conditioning a particle-laden gas comprising forming a mixture of the particle-laden gas and finely divided sodium bisulfate where the gas is at a temperature of 200°–900° C. and the mixture contains 75–1250 grams of sodium bisulfate per metric ton of coal burned to form the gas. Preferably the gas is at a temperature of 350°–750° C. at the time of mixing, and the mixture contains 200–1000 grams of sodium bisulfate per metric ton of coal burned to form the gas. The sodium bisulfate may be added to the gas in the form of either a dry powder or an aqueous solution (preferably at a 10–40% sodium bisulfate concentration by weight).

In a preferred embodiment, the collection characteristics of particles entrained in a particle-laden gas stream are improved for collection by an electrostatic precipitator by injecting finely divided sodium bisulfate into a stream of particle-laden gas formed by the burning of coal while the gas has a temperature of 200°–900° C. Sufficient sodium bisulfate is injected to provide 75–1250 grams of sodium bisulfate per metric ton of coal burned to form the gas. After injection, the gas stream is directed through a heat exchange means and finally into the precipitator to collect the particles therein.

DETAILED DESCRIPTION OF THE PREFERRED EMBODIMENTS

The conditioner useful in the present invention is finely divided sodium bisulfate ($Na\ HSO_4$). The conditioner may be utilized either in dry form (for example, as a powder of finely divided particles) or preferably as a solution. An aqueous solution can be made by dissolving one kilogram of anhydrous sodium sulfate and about 730 grams of concentrated sulfuric acid (95%) in water. This mixture will yield 1.69 kilograms of sodium bisulfate in the water. The solution may also be prepared by dissolving sodium bisulfate, itself, into water or by any other conventional means for preparing an aqueous solution.

The amount of conditioner to be injected into the gas stream at the specified temperature varies according to the amount of solids entrained in the gas stream and the degree of improvement needed in the electrostatic precipitator efficiency, for example, in order to meet a maximum allowable emissions requirement of a local, state or federal regulatory body. Generally for conditioning the fly ash in a coal-burning utility boiler, sufficient conditioner is injected into the gas stream to provide 75–1250, and preferably 200–1000 grams of the conditioner agent (i.e., sodium bisulfate) per metric ton of coal burned to form the gas. Since the flue gas volume is dependent on the temperature of the flue gas, another way of expressing this value is 2.46–41.1., and preferably 6.56–32.9, kilograms of conditioner per million cubic meters of flue gas measured at 649° C. Generally conditioner levels below this range do not appreciable improve the collection characteristics of the particles, while any conditioner levels in excess of the specified range increase the cost of conditioning unnecessarily.

The quantity of sodium bisulfate determined according to the foregoing criteria is preferably added in the form of an atomized aqueous solution, preferably a 10–40% weight salt solution. Higher or lower concentration may be used, however, as the function of the water is merely to facilitate injection of the sodium bisulfate in atomized form into the gas stream, and the water itself is not believed to play a significant part in the process of the present invention.

The mechanism by which the conditioner of the present invention changes the resistivity of the particles in the gas stream is not fully understood. One possible explanation is analogous to that advanced in U.S. Pat. No. 3,523,407, i.e., that the entrained dust particles become enveloped in a film or coating of sodium bisulfate. Since the sodium bisulfate is a better conductor of electricity than the minerals normally present in fly ash, electric current can flow over the surface of the ash particles rather than through them. The effect of this phenomenon is to lower the apparent resistivity of the fly ash and improve its collectability by an electrostatic precipitator.

The temperature of the gas stream at the point of injection must be high enough to rapidly vaporize the carrier water when present and allow the resulting finely divided sodium bisulfate to disperse effectively. It is recommended that the temperature not be in excess of 900° C. for maximum effectiveness. At excessively high injection temperatures a substantial portion of the sodium bisulfate can react with the fly ash substrate. Such reactions tend to produce chemicals which are less effective conditioning agents than sodium bisulfate.

Regardless of the operative mechanism, the present method represents a significant improvement over previous methods employing ammonium salts in that the danger of air preheater pluggage is essentially eliminated over the useful concentration and temperature ranges. In addition, the problems associated with the use of ammonium-salt-conditioned fly ash as a pozzolanic filler in cement formulations are eliminated. Fly ash conditioned with sodium bisulfate according to the present method does not contain added ammonium ion and, therefore, cannot react with the basic components of cement to liberate objectionable ammonia gas.

Another important advantage of the present invention arises out of the fact that the conditioner is effective irrespective of the chemical content of the gas being conditioned; that is, its effectiveness does not depend on dust particles or the gas including a particular initial chemical composition (such as an oxide of sulphur) to provide a chemical reaction which would then combine with the conditioner in situ to condition the particles. Such dependency upon an in situ chemical reaction was one shortcoming of several of the heretofore known practices which required the presence of definite amounts of other chemical constituents in the gas stream, such a dependency being especially significant in view of the current trend to low sulphur fuels.

It will be recognized that an important feature of the present invention is the injection of the conditioner into a gas stream having the proper temperature range. The gas temperature at the point of injection must be sufficiently high to insure proper volatilization of water carrier when present and dispersal of the conditioner prior to contact of the conditioner with the air preheater means or any other heat exchange unit which the conditioner might deposit upon and/or clog. When the gas stream at the point of injection is at least 200° C., the specified quantities of conditioner volatilize and disperse with sufficient speed for this purpose. Of course, if there are not heat exchange units intermediate the point of injection and the collector, somewhat lower injection temperatures may be tolerated provided they are effective to volatilize and disperse the conditioner prior to its contact with the precipitator. However, the presence of an air preheater means or other heat exchange unit intermediate the point of injection and the precipitator is preferred to insure complete and thorough mixing of the dispersed conditioner and any of its decomposition products with the particles entrained in the gas stream.

The maximum temperature of injection should also be regulated since excessively high temperatures will result in decomposition of the conditioner to less effective reaction products. Loss of activity can also result from reaction of the conditioner with the fly ash, particularly when the conditioner is introduced into an area of the boiler where the fly ash is in a molten state. It is recommended that the injection amount and injection temperature be appropriately coordinated (within the ranges specified for the practice of the present invention) to insure the absence of deposits in and clogging of the heat exchange unit, higher injection amounts requiring higher injection temperatures according to the principles of the present invention.

In a typical power station, the flue gas produced by a coal fired boiler passes successively from the boiler through a secondary superheater, a reheater-superheater, a "ball-room", a primary superheater, an economizer, an air preheater, a precipitator, a stack, and ultimately passes into the atomosphere. The temperature of the gas stream entering the ball-room is typically slightly under 900° C., and the temperature of the gas stream entering the air preheater is typically about 300° C. In this situation, the preferred location for the injection ports for the conditioner would be somewhere between the ball-room entry duct and the entrance to the air preheater. However, it is to be understood that this is only an illustrative example and that boilers vary widely in design and operating conditions. The criteria for selection of the injection ports include the temperature of the gas stream at such points, the accessibility of a location permitting good mixing of the conditioner (preferably atomized) with the gas stream, and the absence of direct impingement of the conditioner on the boiler tubing, since that might result in severe damage by thermally shocking the boiler tubing. Preferably, the injection ports are disposed so that the gas stream (containing the conditioner) subsequently passes through the air preheater or some other heat exchange unit to insure thorough mixing of the conditioner and the particles of the gas stream before the gas stream contact the precipitator.

The apparatus for injecting the conditioner into the gas duct may be conventional in design. Apparatus for injecting the conditioner typically includes a supply of the conditioner, nozzle means communicating with the interior of the gas duct, and means connecting the conditioner supply to the nozzle means, such connecting means typically including means for forcing the conditioner through the nozzle, preferably as an atomized spray, and means for metering the amount of conditioner injected, typically in proportion to either the quantity of gas being conditioned or the quantity of coal being burned.

Preferably the conditioner is injected on a continuous basis during operation of the furnace, but clearly it may be alternatively injected on an intermittent or periodic basis.

The following examples will serve to illustrate the application of the present invention. Particulate emission levels, expressed in the examples as kilograms per hour, are conveniently measured by the procedure given in EPA Method No. 5 as described in the Federal Register, Vol. 36, No. 247, Part II, pp. 24,888-24-890 (Dec. 23, 1971).

EXAMPLE I

A 125 Megawatt design capacity forced draft boiler with two Ljungstrom air heaters had been equipped with an American Standard electrostatic precipitator designed for 98% efficiency at 125 Megawatts when burning a coal containing 4.6% sulfur and 15% ash. Because of environmental restrictions on $SO_2$ emissions, this boiler was switched to a coal containing 0.6% sulfur and 14% ash. While burning the high sulfur coal precipitator efficiency had been quite good, but with the low sulfur coal the particulate emissions reached an unacceptable level of 730–1000 kg/hr. To lower the emission level, a 36% aqueous solution of sodium bisulfate was injected into the superheat section of the boiler (where at 125 megawatt load the temperature was about 700° C.).

As indicated by the data recorded in Table I for various treatment rates in grams of sodium bisulfate per metric ton of coal burned, the particulate emissions were reduced to about one half of the untreated level (at equivalent boiler load levels).

TABLE I

| Treatment Rate, Grams/Metric Ton | Emissions, Kilograms/Hour |
|---|---|
| None | 730–1000 |
| 598 | 450 |
| 996 | 370 |

EXAMPLE II

A 575 Megawatt balanced draft boiler with two Ljungstrom air heaters was equipped with a Research Cottrell electrostatic precipitator designed for 97% efficiency based on the analysis of core samples of the lignite to be burned. After the boiler was put into operation, particulate emissions were found to be out of compliance with environmental regulations on numerous occasions. This marginal efficiency of the precipitator was traced to the fact that the lignite actually being burned differed significantly from the core samples which were used as a basis for designing the precipitator.

Table II shows the reduction in particulate emissions brough about by spraying a 36% aqueous solution of sodium bisulfate into the horizontal reheat area of the boiler (the temperature in this area is about 725° C.). Treatment rates are expressed in grams of sodium bisulfate per metric ton of lignite burned.

TABLE II

| Treatment Rate, Grams/Metric Ton | Boiler Load, Megawatts | Emissions Kilograms/hr. | Kilograms/ $10^6$BTU |
|---|---|---|---|
| None[1] | 564 | 1292 | 0.22 |
| 299[2] | 568 | 559 | 0.10 |
| 299[3] | 558 | 537 | 0.10 |

[1]Average of 5 determinations
[2]Average of 9 determination
[3]Average of 13 determinations

EXAMPLE III

A 173 Megawatt boiler with two vertical Ljungstrom air heaters was equipped with a Buell electrostatic precipitator designed to operate at 95% efficiency when burning coal with an ash content of 8%. Because of an increase in the ash content of the coal being burned and increasingly stringent emission regulations it became necessary to condition the fly ash chemically in order to bring particulate emissions within compliance.

The fly ash was conditioned initially by injecting an aquous solution of ammonium sulfate into the superheat area of the boiler. In this installation the furnace load varied widely and rapidly with time, and as a result the temperature at the injection point also varied widely. This treatment was effective in reducing emissions but could not be maintained at a level adequate to achieve compliance without gradual air heater pluggage. In addition, the fly ash collected in the precipitator during treatment could not be used as a pozzolanic filler in cement because of the ammonia gas liberated upon contact of the treated fly ash with wet cement.

Table III illustrates the advantages of using sodium bisulfate according to the method of the present invention rather than ammonium sulfate to condition fly ash. To obtain the data in Table III both compounds were injected into the superheat area of the boiler as 40% aqueous solutions under equivalent conditions and treatment rates. Comparison of the particulate emission levels during the two treatments showed that lower emissions were obtained when injecting sodium bisulfate than when injecting ammonium bisulfate. In addition, examination of the air heater pressure differentials observed during the period of treatment in each case illustrates the difference in plugging tendency for the two compounds. When using the ammonium sulfate a pressure increase of 1.5 cm. of water was observed over a 4 hour period indicating a gradual buildup of the conditioning agent on the air heater which, if continued for an extended period of time, would lead to shutdown of the boiler. Under equivalent conditions using sodium bisulfate no detectable increase in air heater pressure differentials was observed over a six hour period. Also, the fly ash collected during treatment with sodium bisulfate produced no ammonia odor in contact with wet cement and proved to be entirely suitable for this application in all other respects.

Now that the preferred embodiments of the present invention have been shown and described, various modifications and improvements thereon will become readily apparent to those skilled in the art. Accordingly, the spirit and scope of the present invention is to be limited only by the appended claims, and not by the foregoing disclosure.

TABLE III

| Conditioner | Treatment Rate Grams/-Metric Ton | Boiler Load, Megawatt | Time | Air Heater Differential Pressure in Centimeters of Water | Emissions Kilograms/Hour |
|---|---|---|---|---|---|
| $(NH_4)_2SO_4$ | 250 | 155 | 1400 | 13.2 | |
| | 325 | 155 | 1600 | 14.0 | 1014 |
| | 325 | 155 | 1800 | 14.7 | |
| $NaHSO_4$ | 330 | 155 | 1000 | 13.5 | 577 |
| | 330 | 155 | 1200 | 13.5 | |
| | 330 | 155 | 1400 | 13.5 | |
| | 330 | 155 | 1600 | 13.5 | 586 |

We claim:

1. A method of conditioning a particle-laden gas formed by the burning of coal comprising forming a mixture of:
   (A) the particle-laden gas at a temperature of 200°–900° C., and
   (B) finely divided sodium bisulfate; said mixture containing 75–1250 grams of sodium bisulfate per metric ton of coal burned to form said gas;

and thereafter passing the mixture through an electrostatic precipitator.

2. The method of claim 1 wherein said gas is at a temperature of 350°–750° C. at the time said sodium bisulfate is mixed therewith.

3. The method of claim 2 wherein said sodium bisulfate is mixed with said gas in the form of an aqueous solution and in sufficient quantity to provide 200–1000 grams of sodium bisulfate per metric ton of coal burned to form said gas.

4. The method of claim 2 wherein said mixture contains 200–1000 grams of sodium bisulfate per metric ton of coal burned to form said gas.

5. The method of claim 1 wherein said sodium bisulfate is mixed with said gas in the form of an aqueous solution.

6. The method of claim 5 wherein said mixture contains 200–1000 grams of sodium bisulfate per metric ton of coal burned to form said gas.

7. The method of claim 5 wherein said aqueous solution comprises about 10–40 parts of sodium bisulfate and 60–90 parts by weight of water.

8. The method of claim 7 wherein said sodium bisulfate is injected in the form of a dry powder.

9. The method of claim 8 wherein 200–1000 grams of sodium bisulfate are injected per metric ton of coal burned to form said gas.

10. The method of claim 1 wherein said sodium bisulfate is in the form of a dry powder.

11. The method of claim 10 wherein said mixture contains 200–1000 grams of sodium bisulfate per metric ton of coal burned to form said gas.

12. The method of claim 1 wherein said mixture contains 200–1000 grams of sodium bisulfate per metric ton of coal burned to form said gas.

13. The method of claim 1 wherein said sodium bisulfate is mixed with said gas in the form of an aqueous solution and in sufficient quantity to provide 200–1000 grams of sodium bisulfate per metric ton of coal burned to form said gas.

14. The method of claim 1 including the additional step of passing said mixture through heat exchange means.

15. The method of claim 14 wherein said sodium bisulfate is mixed with said gas in the form of an aqueous solution and in sufficient quantity to provide 200–1000 grams of sodium bisulfate per metric ton of coal burned to form said gas.

16. A method of improving the collection characteristics of particles entrained in a stream of particle-laden gas formed by the burning of coal for collection by and electrostatic precipitator, comprising the steps of:
   (A) injecting finely divided sodium bisulfate into said stream of particle-laden gas while said gas has a temperature of 200°–900° C., sufficient sodium bisulfate being injected to provide 75–1250 grams of sodium bisulfate per metric ton of coal burned to form said gas; and
   (B) after said injection, directing said gas stream through a heat exchange means into an electrostatic precipitator to collect said particles therein.

17. The method of claim 16 wherein said gas is at a temperature of 350°–750° C. at the point of injection.

18. The method of claim 17 wherein 200–1000 grams of sodium bisulfate are injected per metric ton of coal burned to form said gas.

19. The method of claim 16 wherein said sodium bisulfate is injected in a form of an aqueous solution and in sufficient quantity to provide 200–1000 grams of sodium bisulfate per metric ton of coal burned to form said gas.

20. The method of claim 17 wherein said sodium bisulfate is injected in a form of an aqueous solution and in sufficient quantity to provide 200–1000 grams of sodium bisulfate per metric ton of coal burned to form said gas.

21. The method of claim 16 wherein said sodium bisulfate is injected in the form of an aqueous solution.

22. The method of claim 21 wherein said aqueous solution comprises about 10–40 parts of sodium bisulfate and 60–90 parts by weight of water.

23. The method of claim 21 wherein 200–1000 grams of sodium busulfate are injected per metric ton of coal burned to form said gas.

24. The method of claim 16 wherein 200–1000 grams of sodium bisulfate are injected per metric ton of coal burned to form said gas.

25. A method of conditioning a particle-laden gas formed by the burning of coal comprising forming a mixture of:
   (A) a particle-laden gas at a temperature of 200–900° C., and
   (B) finely divided sodium bisulfate; said mixture containing 2.45-41.1 kilograms of said sodium bisulfate per million cubic meters of said gas at 649° C.; and thereafter passing said mixtue through an electrostatic precipitator.

26. The method of claim 25 wherein said mixture contains 6.56–32.9 kilograms of said sodium bisulfate per million cubic meters of said gas at 649° C.

27. A method of improving the collection characteristics of particle entrained in a particle-laden gas stream for collection by an electrostatic precipitator, comprising the steps of:

(A) injecting finely divided sodium bisulfate into a stream of particle-laden gas while said gas has a temperature of 200–900° C., sufficient sodium bisulfate being injected to provide 2.46–41.1 kilograms of sodium bisulfate per million cubic meters of said gas at 649° C.;

(B) after said injection, directing said gas stream through a heat exchange means and into and electrostatic precipitator to collect said particles thereon.

28. The method of claim 27 wherein 6.56–32.9 kilograms of said sodium bisulfate are injected per million cubic meters of said gas at 649° C.

* * * * *

Disclaimer and Dedication 4,113,447.—*Robert P. Bennett,* Bridgewater and *Alfred E. Kober,* Hopatcong, N.J. METHOD OF CONDITIONING FLUE GAS. Patent dated Sept. 12, 1978. Disclaimer and Dedication filed Mar. 10, 1983, by the assignee, *Economics Laboratory, Inc.*

Hereby disclaims and dedicates to the Public the entire remaining term of said patent.

[*Official Gazette September 27, 1983.*]